United States Patent [19]

Herchenroeder

[11] 4,312,682

[45] Jan. 26, 1982

[54] METHOD OF HEAT TREATING NICKEL-BASE ALLOYS FOR USE AS CERAMIC KILN HARDWARE AND PRODUCT

[75] Inventor: Robert B. H. Herchenroeder, Kokomo, Ind.

[73] Assignee: Cabot Corporation, Kokomo, Ind.

[21] Appl. No.: 106,304

[22] Filed: Dec. 21, 1979

[51] Int. Cl.[3] ..... C22F 1/10

[52] U.S. Cl. ..... 148/2; 75/171; 148/11.5 N; 148/31.5

[58] Field of Search ..... 75/171, 170, 10 R; 148/32, 32.5, 31.5, 2, 11.5 N

[56] References Cited

U.S. PATENT DOCUMENTS

| | | | |
|---|---|---|---|
| 3,067,473 | 12/1962 | Hopkins | 75/10 R |
| 3,754,902 | 8/1973 | Boone et al. | 75/171 |
| 3,832,167 | 8/1974 | Shaw et al. | 75/171 |

FOREIGN PATENT DOCUMENTS

| | | |
|---|---|---|
| 1196714 | 7/1970 | United Kingdom . |
| 1262757 | 2/1972 | United Kingdom . |
| 1397066 | 6/1975 | United Kingdom . |
| 1512811 | 6/1978 | United Kingdom . |
| 1512984 | 6/1978 | United Kingdom . |
| 1544720 | 4/1979 | United Kingdom . |

*Primary Examiner*—R. Dean

*Attorney, Agent, or Firm*—Jack Schuman; Joseph J. Phillips

[57] ABSTRACT

Disclosed is a NICRALY alloy containing nominally about 16% chromium, about 5.3% aluminum, about 0.02% yttrium and the balance essentially nickel, and heat treated in a manner to develop an essentially aluminum oxide surface. The NICRALY alloy is especially suited for use as components and support systems in kilns that are used in the firing steps in the manufacture of ceramic articles.

5 Claims, No Drawings

METHOD OF HEAT TREATING NICKEL-BASE ALLOYS FOR USE AS CERAMIC KILN HARDWARE AND PRODUCT

This invention relates to nickel-base oxidation resistant alloys, particularly to Ni-Cr-Al-Y alloys, and methods of heat treating them for use as accessory kiln hardware, components and support systems of kilns used in the manufacture of ceramic products.

Known in the art is a class of superalloy known as NICRALY, these alloys contain chromium, aluminum and yttrium in a nickel base. Typical alloys of this class are described in many U.S. patents and especially in U.S. Pat. No. 3,754,902.

In the manufacture of typical ceramic products (often called pottery), the ceramics, clays, and other non-metallic minerals together with associated glazes are usually heated to elevated temperatures three times. The term "ceramic products" (and pottery) as used herein includes earthenware, porcelain, brick, glass, nitreous enamels and the like products.

The three firing ranges include:

1. "Bisque Firing" which removes impurities of nature and which transforms the clay mixtures into irreversible chemical compounds. Firing temperatures are typically 2100°-2230° F. (1150°-1220° C.),
2. "Glost Firing" during which the glossy glaze layer is fixed to the ceramic substrate at temperatures of about 1830°-2010° F. (1000°-1100° C.), and
3. "Decorating Operation" during which decals, colors, hand paintings or other decorations are affixed to the pottery. Temperature ranges for these operations are typically about 1380°-1830° F. (750°-1000° C.).

Because the in-process ceramic articles are fragile and cannot stand sudden extreme changes in temperature without cracking, heating cycles typically start at or near ambient temperature, and are slowly raised to the required firing temperature. Typical firing cycles are of the order of 24-48 hours in duration in an oxidizing atmosphere although vacuum or low oxygen potential atmospheres could be advantageously utilized.

During the firing operations, the ceramic articles must be supported so that the articles retain the proper shape, while allowing for movement of the parts and support system because of thermal expansion, without marring the surface finish of the ceramic product. To do this, the alloy may be produced in the form of plate, rod or wire and fashioned into various support framework devices to hold in-process ceramic objects during the firing cycle. Examples of such devices include pedestals, stilts, cradles and the like.

In the present art, these support systems or "kiln hardware" are constructed from refractory-type materials into components, which, in turn, require preforming and firing to render them serviceable. The term "kiln hardware" used herein refers to component parts and support systems relating to kilns used in ceramic processing.

These refractory kiln hardware components have numerous faults, shortcomings and disadvantages. They are difficult to make and join, costly, friable, brittle and bulky. Further, the present refractory-type kiln hardware tends to have a short life, in many instances, only one kiln cycle. Furthermore, the ratio of the weight of unsaleable refractory support systems to saleable product typically is about 2:1 and frequently reaches 3:1.

When considering the required energy waste of such systems, it becomes imperative to devise and develop more energy efficient methods of producing ceramic products. To achieve the required efficiency, support systems which can be cycled more rapidly and which have less bulk are required. In addition to the energy efficiency required, it is also desirable to reduce the tendency of the systems to suddenly crack and break (often destroying an entire kiln load of product) or simply break during the normal handling of these fragile systems.

An apparently obvious solution to the above-described difficulties would be a metal support system, and this has, indeed, been unsuccessfully tried.

Stainless steels were tried but, in the long run, the steels lacked sufficient strength and oxidation resistance. High temperature "superalloys" of the nickel-chromium type, for example 80-20 alloys, provided adequate strength levels but left unacceptable discoloration on the finished product, because of interaction of the in-process ceramic articles and ceramic glaze systems with the naturally forming oxides of the alloys investigated. Metal alloys coated with various formulations were also investigated. Inconsistent results and poor reliability resulted. Thus, what seemed to be an obvious, simple solution to the problem of the ceramic industry, in fact proved to be no solution at all.

It is an object of this invention to provide articles particularly suited for use as kiln hardware.

It is another object of this invention to provide a heat treatment method that enhances the characteristics of kiln hardware articles.

Other objects and aims are apparent in the following specification and claims.

The present invention broadly provides a NICRALY alloy article and an oxidizing heat treatment to make the article eminently suited for use as kiln hardware.

Through experimentation, it has been discovered that a predominantly aluminum oxide scale on an alloy surface is essentially inert to most of the raw material mixtures and glazes in the temperature ranges used by the ceramic industry. It has been further discovered that alloys of Ni-Cr-Al-Y type provide such an aluminum oxide scale when exposed to high temperatures, that these scales are essentially self-healing and that the scales or oxides are resistant to spalling.

Finally, it has been discovered that the best results have been achieved when the Ni-Cr-Al-Y alloy has been preoxidized at high temperatures to preform the insulating- protective-, non-reactive oxide scale prior to contact of the surface with the in-process ceramic products to be supported.

A series of heat treatments were performed on a NICRALY alloy to establish heating parameters which would adequately form the desired scale interface for use between alloy and the in-process ceramic products.

The alloys used in these tests were comprised essentially of 15% chromium, 5% aluminum, 0.02% yttrium and the balance nickel. A working range of these alloys may vary about 10 to 20% chromium, about 3 to 7% aluminum and an effective amount about 0.005 to 0.035% yttrium and balance nickel plus impurities and modifying elements, provided the modifying elements do not deteriorate the oxide scale that is resistant to discoloration of in-process ceramic ware. However, many modifications of the basic NICRALY alloy may be made within the ranges 8 to 25% chromium, 2.5 to 8% aluminum, a small but effective yttrium content not over 0.04% and the balance nickel and impurities plus modifying elements optionally selected from the groups: up to 15% total Mo, Rh, Hf, W, Ta, and Cb; up to 0.5% total C, B, Mg, Zr and Ca; up to 1% Si; up to 2% Mn; up to 20% Co; up to 5% Ti and up to 30% Fe, provided the alloy forms a predominantly aluminum oxide scale. The alloys were (1) melted to composition; (2) electroslag remelted (ESR) into shapes for further metal working; and, (3) worked into final shape.

The experimental program to evaluate proper heat treatments resulted in the following basic conclusions.

1. Heat treatment of the subject alloy for one hour at 2100° F. provided an adequate oxide film.
2. The rate of heating to 2100° F. was not critical.
3. Cold rolling the subject alloy to a reduction of nominally 20% then exposing the alloy at 2000° F. for a time of seven (7) hours provided an adequate oxide film.
4. Surface grinding the previously annealed alloy to a 120-grit finish and exposing it at 2000° F. for seven hours provided only a marginally acceptable oxide film.
5. Simple exposure of the subject alloy at temperatures below 2000° F. did not provide an adequate (a predominantly aluminum oxide) film. At these temperatures, a mixture of green (presumably $Cr_2O_3$) and silver gray (presumably $Al_2O_3$) oxides formed.
6. Exposure of the subject alloy for 20 minutes in flowing argon (a simulated bright anneal treatment) created what appeared to be a film of $Al_2O_3$ but of questionable thickness to provide the desired interface.
7. ESR processed alloy is the preferred method of production.

From these results, it is concluded that the subject alloy would achieve the best surface oxide for interface with ceramic parts during firing by being pre-oxidized in an oxygen-bearing atmosphere at a temperature over about 2000° F., for example greater than 2100° F., and preferably over about 2150° F., but below the melting temperature of the alloy for a time dependent upon the condition of the alloy surface, the oxygen potential of the atmosphere and the temperature (an exponential factor).

NICRALY alloys may be produced by a variety of processes, powder metallurgy, castings, wrought processes and the like as is well known in the art. It is preferred, for optimum results, to produce the alloy by the electroslag remelting (ESR) process, then hot and/or cold roll to the desired article before the critical oxidation step.

While several methods have been described as a result of testing, other modifications may be made within the scope of the invention and within the following claims.

What is claimed is:

1. The method for producing a kiln hardware article for use in the manufacture of ceramic products including the steps of:

a. providing an alloy consisting essentially of, in weight percent, 8 to 25 chromium, 2.5 to 8 aluminum, a small but effective yttrium content not exceeding over 0.04, and the balance nickel and impurities plus modifying elements optionally selected from the groups: up to 15 total Mo, Rh, Hf, W, Ta and Cb; up to 0.5 total C, B, Mg, Zr and Ca; up to 1Si, up to 2Mn, up to 20Co, up to 5Ti, and up to 30Fe b. fashioning said alloy into said article with a required shape for said use, and c. heat treating said fashioned article to provide a predominantly aluminum oxide film of the surface of said article.

2. The method of claim 1 wherein said alloy contains about 10 to 20 chromium, about 3 to 7 aluminum and about 0.005 to 0.035 yttrium.

3. The method of claim 1 wherein step "a" includes providing said alloy by ESR process and then hot and/or cold working said alloy.

4. The method of claim 1 wherein the heat treatment of step "c" comprises heat treating said article at a temperature over 2000° F. for at least one hour.

5. A kiln hardware article made by the process of claim 1.

* * * * *